United States Patent [19]

Barriac

[11] Patent Number: 4,731,512

[45] Date of Patent: Mar. 15, 1988

[54] CHILD RESISTANT CLOSURE WITH EASY OPEN FEATURE FOR THE MANUALLY HANDICAPPED

[75] Inventor: Jacques J. Barriac, Toledo, Ohio

[73] Assignee: Owens-Illinois Closure Inc., Toledo, Ohio

[21] Appl. No.: 23,742

[22] Filed: Mar. 9, 1987

[51] Int. Cl.[4] ..... B65D 55/02

[52] U.S. Cl. ..... 215/220; 215/215; 215/295

[58] Field of Search ..... 215/215, 220, 295; 220/284

[56] References Cited

U.S. PATENT DOCUMENTS

| | | | |
|---|---|---|---|
| 2,921,705 | 1/1960 | Dorsey | 215/220 |
| 3,863,796 | 2/1975 | Roy | 215/220 |
| 4,469,235 | 9/1984 | Parker | 215/295 |

*Primary Examiner*—George T. Hall

[57] ABSTRACT

A two-piece, press-twist, child resistant closure is formed with upwardly extending lugs, protrusions, ribs or channels on the upper surface of the outer closure member. The lugs assist in holding the outer closure against rotation while being axially depressed to engage the inner closure so that rotation of the container relative to the closure will effect removal of the closure. The closure system serves as a convenient system for arthritic or manually handicapped adults to use and still retain the child resistant nature of the closure for bottles containing harmful products.

8 Claims, 9 Drawing Figures

CHILD RESISTANT CLOSURE WITH EASY OPEN FEATURE FOR THE MANUALLY HANDICAPPED

BACKGROUND OF THE INVENTION

It has become the practice to use child resistant closures for containers that have medicine or other products which might be harmful to small children. One problem with these closures is that they are hard to open by adults that have arthritis or are unable to grip a closure with sufficient strength to effect opening of the container by using two hands, particularly where one hand is unable to grip the closure with the required strength.

The CR closure of the invention can be opened by adults via the usual "push down and turn to open" by handling the closure manually with one hand.

One example of the usual "palm and turn" closure is disclosed in U.S. Pat. No. 3,857,505, issued 12/3/74. This patent shows the plastic overcap with the interengaging lugs that are actuated by pressing down on the overcap until the lugs engage so that rotation of the overcap will result in unthreading of the underneath closure.

Child resistant closures were created to reduce the accidental ingestion of dangerous substances by small children. The objective was to provide a closure system too difficult to open by small children but easy to open by adults.

Although the closure industry has been successful meeting the first objective, it is well known that child resistant closures are a constant source of irritation for adults who have great difficulties opening these CR closures. It is also well known that many senior citizens, and persons with arthritis, cannot physically open a CR closure. As a result, the containers are left open or the CR closure is replaced by a standard closure which defeats the very purpose of a CR closure. All CR closures require at least two consecutive or synchronized operations to open a CR package. For example:

1. A CR snap cap requires the rotation of the cap to align two arrows and then lift the cap;
2. A "squeeze and turn" closure requires the operator to squeeze the skirt of the closure at two specific locations and rotate the closure;
3. A "screw-loc" closure requires the operator to push down and rotate; and
4. Most two-piece CR closures require the operator to push down and rotate or pull up and rotate.

It should be noted that in all cases the closure, which is usually the smallest part of the package, must be handled by the hand or the fingers (rotated or squeezed) which may be physically too difficult for some adults, most senior citizens, and nearly all handicapped persons.

In addition to the child resistant closure exemplified in the above referenced U.S. Pat. Nos. 3,857,505, 4,469,235, issued Sept. 4, 1984, discloses the concept of a regular threaded closure having upstanding tabs on the top to give persons with an arthritic condition a means to increase the torque applied to the closure without positively gripping the skirt of the closure. This closure, however, is not a "press and twist" child resistant closure.

SUMMARY OF THE INVENTION

A child resistant closure system that can be manually operable by an adult with arthritis or other physical problem with the hands where manipulation of the closure to open it can be accomplished without having to perform two tasks simultaneously with the hands to effect opening of the container.

With the foregoing in view, it is an object of this invention to provide a means to unlock the CR closure without the one-hand manipulation of the closure.

It is a further object of this invention to provide lugs, protrusions, ribs, channels, etc., on the top of the closure (the outer closure of the two-piece CR) so that by holding the container with both hands and wedging the protrusions, lugs, or ribs provided on top of the closure against the edge of a desk, table, drawer, handle, etc., a slight axial pressure against the container will cause the CR mechanism to engage; and by rotating the whole container with one or both hands while maintaining the axial pressure, the CR closure can be unscrewed easily. The protrusions, lugs, ribs, or channels in combination with the sharp edge of a table, drawer, or handle, acts as a lever, or the protrusions or lugs may be engaged by a linear member, such as a pencil, which can act as a torque lever held over the cap by one hand with the axial pressure applied by the hand or against the hand and the container rotated to effect unthreading of the inner closure of a child resistant "press-twist" closure system.

Other objects will be apparent from the following description taken in conjunction with the annexed sheets of drawings.

DETAILED DESCRIPTION OF THE DRAWINGS

Figure 1:
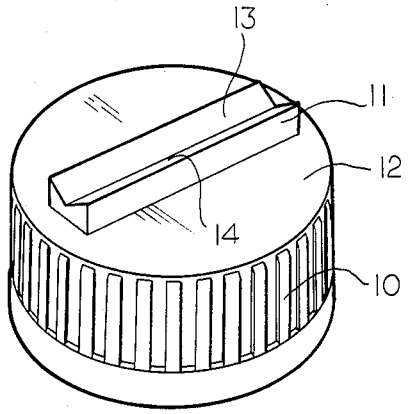
FIG. 1 is a perspective view of a first embodiment of the invention.

With reference to the drawings, a first embodiment of the invention is illustrated in FIG. 1 where the two-piece "press and turn" or "press-twist" closure has a channel member 11 integrally formed, diametrically across the top 12. It should be noted that the member 11 forms a channel that has a 90° angle formed between sides 13 and 14 thereof.

Figure 2:
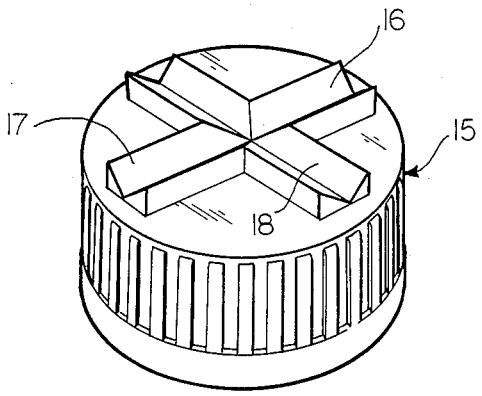
FIGS. 2, 3, 4, 5, 6, and 7 are each a perspective view of additional embodiments of the invention.

FIG. 2 specifically shows an outer closure 15 that has a member 16 formed on the top thereof. The member 16 is in the form of a pair of crossed channels 17 and 18 similar to the channel formed in the embodiment of FIG. 1. The channels 17 and 18, in effect, provide two alternative grooves that extend across the diameter of the closure top. In the embodiments of FIGS. 1 and 2, the closure may be released from a container by placing the channel member 11 or 16 against the 90° edge of a table with the edge in the channel and then applying a force in the direction of the table edge while rotating the container. The container, which usually is larger than the closure, may be more easily gripped for rotation than the closure by someone with arthritic hands. In fact, the container can be held in both hands and the axial force applied with body weight to give the required "press and turn" manipulation of the closure.

Figure 3:
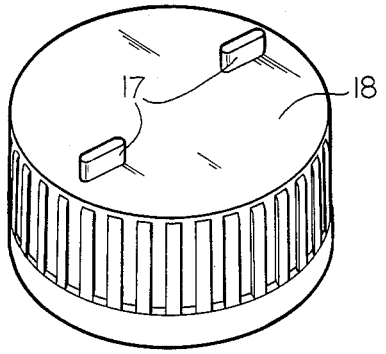
Figure 4:
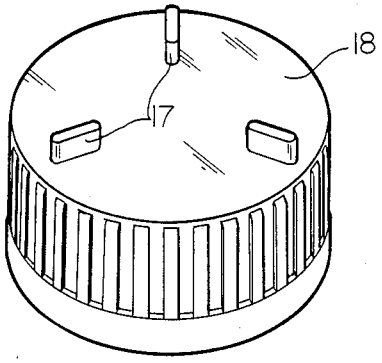
Figure 5:
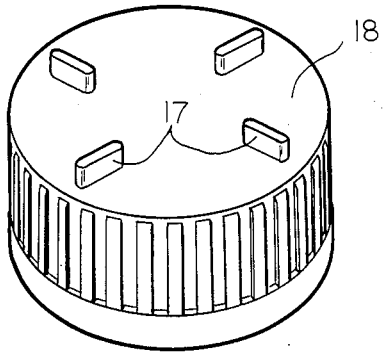

FIGS. 3–5 illustrate several additional embodiments of the invention where rectangular, raised lugs 17 are formed on the top of an outer closure 18. It should be noted that the lugs 17, whether two as in FIG. 3 or four as in FIG. 5, are placed so that a diameter of the closure will be open between an offset pair thereof so that the edge of a table or drawer, or a pencil, can be positioned thereacross to serve as a lever to assist in the depression and twisting of the closure relative to the container to which it is applied. The embodiment of FIG. 4, which shows three lugs, will function much the same as those of FIGS. 3 and 5 except the table edge will be slightly off the diameter of the closure depending on the size and length of the lugs. It should be apparent that the height of the lugs need only be sufficient to engage the edge of a table or other stationary edge and not slip when the container is rotated while being pushed.

Figure 6:
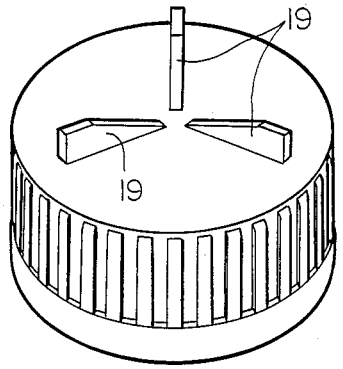

FIG. 6 shows an additional embodiment of the invention where the lugs 19 have a somewhat different configuration than those of FIGS. 3–5 but will still function in the same manner to assist in the removal of the CR closure from a container.

Figure 7:
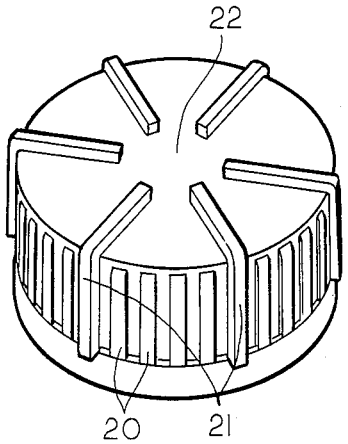

The embodiment illustrated in FIG. 7 is one where the usual plastic closure that is formed with vertical ribs 20 about the skirt thereof have several spaced-apart extensions 21 thereof that extend over the top 22 of the closure to provide, in effect, the required lugs which can engage the corner of a table or other stable member, such as the edge of a door, for example. A suitable material for forming the closures of the invention is a polypropylene, although other suitable molded plastics may serve as long as they have the necessary mechanical strength.

Figure 8:
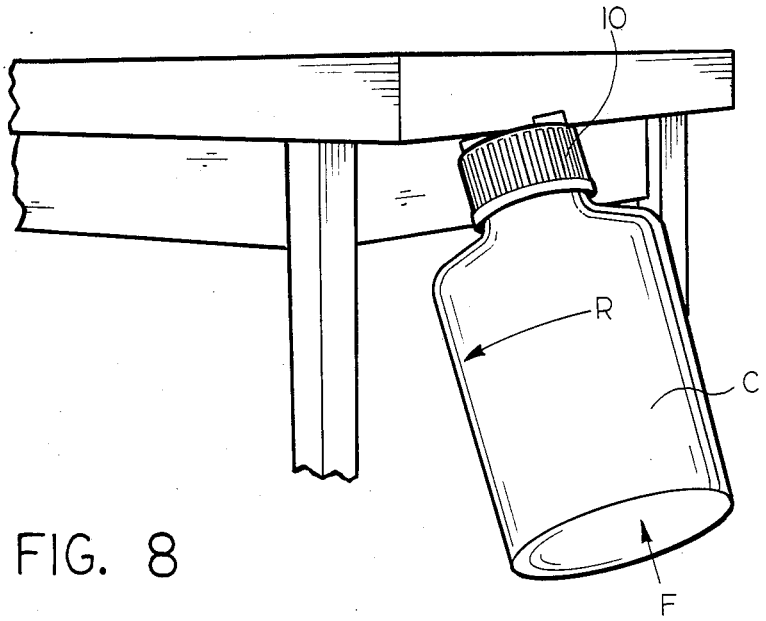
FIG. 8 is a perspective view of the preferred manner of manipulating the container and closures of the invention to effect removal thereof.

The illustration of FIG. 8 shows how the closure of any of the embodiments of FIGS. 1–7 can be held against the lower 90° edge of a table when the container "C" contains a liquid product, such as a detergent or ammonia.

In the case where the contents of the container will not flow by gravity from the container when the CR closure is initially released, it is readily apparent that the top edge of a table can be used as the lever for assisting in turning the closure that is pressed downward against the table edge.

Figure 9:
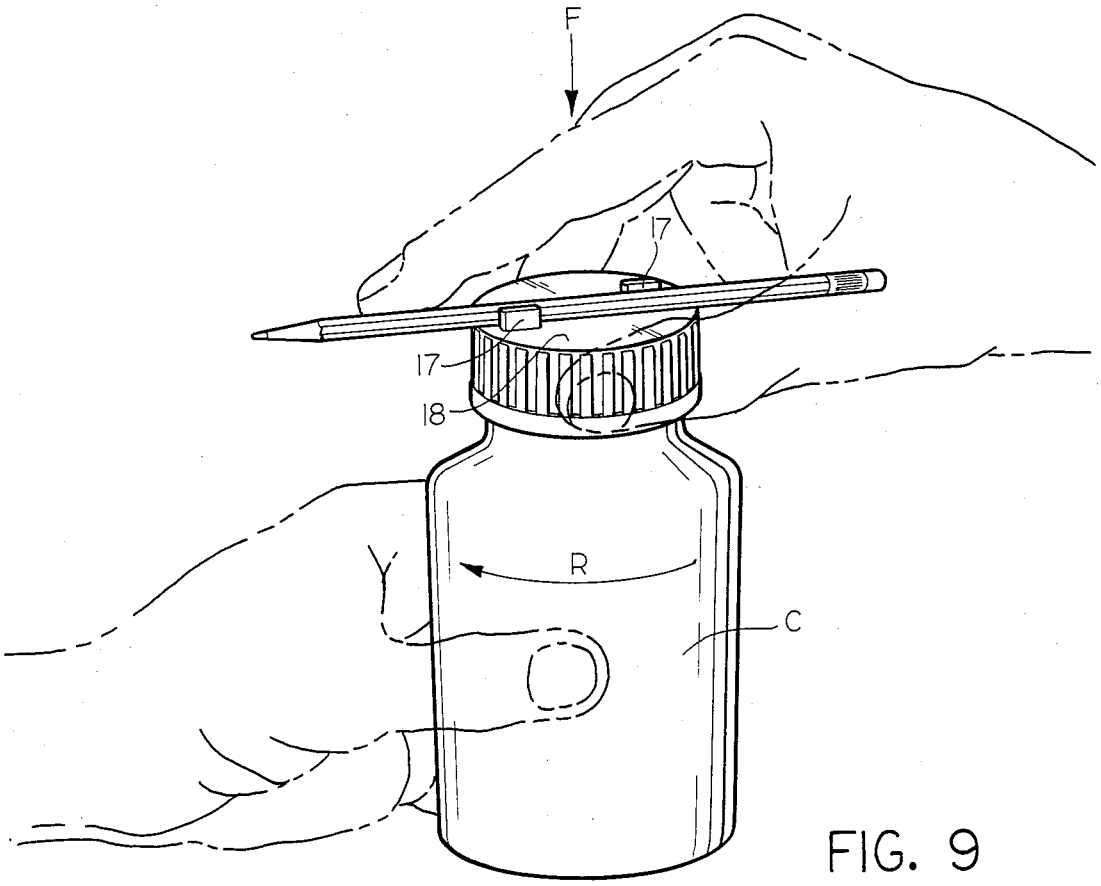
FIG. 9 is a perspective view of an alternate manner of manipulating the container and closures of the invention to effect removal thereof.

With reference to FIG. 9, there is shown an alternative means of manipulating the two-piece, child resistant closure with lugs of the invention, such as that illustrated in FIG. 3, where a linear member or straight edge, such as a pencil "P", is placed across the diameter of the outer closure top 18 and is wedged between the lugs 17. The hand illustrated need only push down in the direction of the arrow F to engage the outer and threaded inner closure of the CR closure and the other hand can rotate the bottle or container C in the direction R to unscrew the closure from the container. The pencil will serve as the means to hold the closure stationary without requiring the gripping or grasping of the closure with the fingers. Thus the one hand only has to perform a pushing function while the other hand rotates the container.

While the foregoing has illustrated several embodiments of the invention, it is apparent that many other configurations of lugs, protrusions, ribs or channels can be used to provide the mechanism for the child resistant closure, and table edge manipulation, within the spirit of the invention.

What is claimed:

1. A two-piece press-twist, child resistant closure for a container wherein an inner closure member threads onto the container neck and the outer closure member is free to rotate with respect thereto, the outer closure will drivingly engage the inner closure when it is axially depressed, the improvement in the outer member comprising, raised means mounted on top of the outer member, said raised means being engageable with a straight edge of a table or other stable surface wherein the closure may be removed by pressing the closure against the straight edge and rotating the container.

2. The closure of claim 1 wherein said raised means comprises, a diametrically extending member formed integrally with said outer cap, said member having a 90° channel, opening upward, in its upper surface.

3. The closure of claim 2 wherein said diametrically extending member extends in two directions at 90° with respect to one another and said 90° channel in one direction intersects with a 90° channel formed in the other direction.

4. The closure of claim 1 wherein said raised means comprises, at least one pair of upwardly extending rectangular lugs on the top of said outer closure, said lugs being mutually positioned on opposite sides of the diameter of said outer closure.

5. The closure of claim 4 further including a second pair of raised lugs, said second pair of lugs being mutually positioned on opposite sides of a diameter of said outer closure top that is turned 90° with respect to the diameter defining the location of said lugs at least one pair of lugs.

6. The child resist.ant closure of claim 1 wherein said raised means on the top of the closure comprises, radially extending ribs at spaced intervals about the circumference of the top of the outer closure.

7. The child resistant closure of claim 1 wherein said raised means comprises, three vertically extending lugs on the top of said outer closure, said lugs being equispaced about the circumference of the closure top and are formed with a height sufficient to engage the edge of a table or other surface without relative movement when pressed thereagainst.

8. The closure of claims 1, 2, 3, 4, 5, 6 or 7 wherein said raised means are formed integrally with the top of the outer closure.

* * * * *